United States Patent [19]

Bourlier

[11] 4,190,003

[45] Feb. 26, 1980

[54] COUNTER WINDOW FOR USE IN PARTICULAR IN CHEMIST'S SHOPS

[75] Inventor: Claude Bourlier, Saint Maurice, France

[73] Assignee: Societe Hygiaphone V.B., Fontenay sous Bois, France

[21] Appl. No.: 934,864

[22] Filed: Aug. 18, 1978

[30] Foreign Application Priority Data

Oct. 7, 1977 [FR] France ..... 77 30272

[51] Int. Cl.[2] ..... E05G 7/00

[52] U.S. Cl. ..... 109/19; 109/21.5

[58] Field of Search ..... 109/2, 10, 11, 19, 21.5; 232/13, 44; 186/1 C

[56] References Cited

U.S. PATENT DOCUMENTS

| | | | |
|---|---|---|---|
| 1,314,513 | 9/1919 | Donahue | 109/19 X |
| 1,673,882 | 6/1928 | Platt | 109/19 |
| 2,034,336 | 3/1936 | Flack | 109/19 X |
| 2,223,169 | 11/1940 | Ellithorpe | 109/19 |
| 2,273,971 | 2/1942 | Love | 109/11 |
| 2,583,182 | 1/1952 | Lyman | 232/13 X |
| 2,896,748 | 7/1959 | McClintock | 109/19 X |
| 3,021,050 | 2/1962 | Rogers | 232/44 X |
| 3,024,970 | 3/1962 | Powers | 232/44 |

*Primary Examiner*—David H. Corbin

*Attorney, Agent, or Firm*—O'Brien & Marks

[57] ABSTRACT

The protected counter window comprises a frame incorporated in a partition wall separating the dispensary from the public. There is a peep hole and a transfer and exchange opening in the window. The window has a trough which is pivotally mounted in the transfer opening and is capable of pivoting alternately to the official's side or to the public side without breaking the physical seal of the protected counter window.

The latter is applicable to any premises requiring high safety during exchanges between the official and the public.

8 Claims, 5 Drawing Figures

COUNTER WINDOW FOR USE IN PARTICULAR IN CHEMIST'S SHOPS

BACKGROUND OF THE INVENTION

The invention relates to a counter window intended in particular for chemist's shops, banks, hospitals, jewellers and generally any public or private service requiring for reasons of safety of articles of value or persons, inaccessibility of the public to the private premises while allowing an auditory exchange and a transfer of objects, documents or money.

In the specific case of chemist's shops, here taken by way of example, there is a need owing to the many attacks on record, in particular in night dispensaries, to give these businesses protective means which shields the officials from the threats they are exposed to when the public has direct access to the counter. Indeed, owing to the many misfortunes of their colleagues, many chemists have decided to no longer maintain their premises open beyond a late hour of the night, which obviously considerably inconveniences users requiring treatment or an immediate remedy. Moreover, apart from the aforementioned problems of safety, employees also hesitate to work at night and in particular to remain awake for long hours of presence for a few occasional customers. From the economic point of view, this situation is also regrettable, especially as it is necessary to double the night staff for reasons of safety.

SUMMARY OF THE INVENTION

An object of the invention is to overcome these various problems and to provide chemist's shops, and in particular those open at night, with a protected counter window comprising a combination of signalling, calling, visual checking and auditory- and article-exchanging means affording complete safety.

According to the invention, there is provided a protected counter window for use in particular in chemist's shops, of the type comprising a frame incorporated in a partition wall separating the dispensary from the public and including a peep hole and a transfer and exchange opening, wherein there is provided a trough which is pivotally mounted in the transfer opening, this trough being capable of alternately pivoting to the official's side or to the public's side without breaking the physical sealing of the counter window.

According to a preferred embodiment, the bottom edge of the trough which is located substantially in the plane of the outer face of the counter window (public side), is pivotally mounted on the lower edge of the transfer opening. According to a feature of the invention, the trough is maintained fixed in the hermetically closing position with respect to the transfer opening by a locking knob located on the dispensary side.

BRIEF DESCRIPTION OF THE DRAWINGS

A protected counter window according to the invention is shown merely by way of example in the accompanying drawings in which.

DESCRIPTION OF THE PREFERRED EMBODIMENTS OF THE INVENTION

Figure 1:
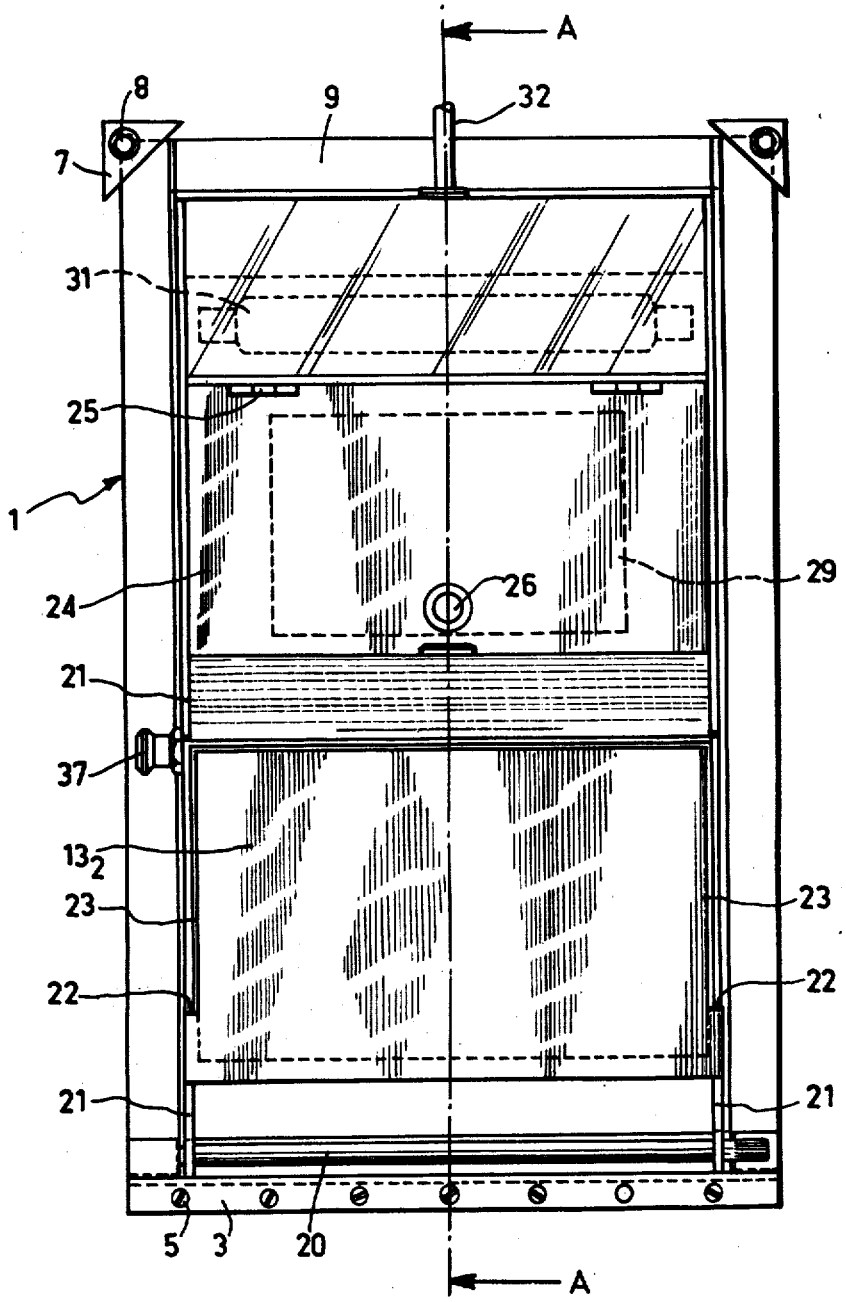
FIG. 1 is a rear elevational view of the protected counter window (the private side)

The counter window illustrated in the accompanying drawings is, in the considered embodiment, intended for chemist's shops or dispensaries of the same type. However, it will be understood, as mentioned before, that this window may be of use in other types of business or other public or private premises without departing from the scope of the invention defined in the claims.

In the present case, the protected counter window comprises a frame 1 in the shape of a parallel-sided box structure the periphery of which (FIG. 2) is formed by a planar flange 2 which may be held fast by detachable locking means so as to permit the possible withdrawal of the counter window. These locking means are formed in the presently-described embodiment by a Z-section member 3 fixed to the partition wall 4 (partitioning the public premises off from the private premises) by screws 5, this section member defining a groove 6 which extends transversely of the window and in which the foot of the window is engaged. The section member is permamently fixed in position.

The upper part of the window is immobilized by triangular plates or corner members 7 which are fixed to the partition wall 4 by removable nuts 8. Consequently, the official can easily remove the plates 7 which maintain the upper edge 9 of the frame in position, by unscrewing the nuts 8 so as to be able to raise the counter window slightly and withdraw the foot of the window from the section member 3.

This window may be replaced by a plate of the same size and fixed in the same way. This plate may be a blank plate or have any required information for the public.

The detachable quality of the counter window is of more advantage for chemist's shops which are in turn open in the daytime or at night, since this counter window is of no particular use in the daytime (and may be consequently replaced by the aforementioned plate) but highly necessary at night.

The frame comprises in fact three separate parts:

the first being formed by a document- or article-transfer opening 10, the second by a peep hole 11, the third by a luminous signalling box 12.

The opening for transferring and exchanging documents, articles or money is in accordance with the invention masked by a trough 13 which in the presently-described embodiment has a substantially parallel-sided shape. This trough has the feature of being pivotally mounted on the lower edge 14 of the opening 10 by a pivotal connection 15 coinciding with the front edge 16 of the trough 13.

This pivotal connection is located in such manner relative to the corner 16 of the trough that its front face $13_1$ is in the vertical plane of the window so as to close the opening 10 when the shutter is in the position determined by a locking knob 37 which extends through a slide plate of the frame and into the trough.

It will be understood that this trough may have any other shape and in particular may have a triangular shape or the shape of a sector without departing from the gist of the invention.

Consequently, owning to its pivotal mounting, the trough may be brought alternately to the public side as illustrated at 17 or to the official's side as illustrated at 18 so as to allow each one access to the interior of the trough.

When the trough is pivoted to the position 18, its front side $13_1$ is, as shown in dot-dash lines, in a plane opposing any access to the interior of the private premises, since the upper part of the opening 10 is masked by a depending flap 19 extending from the official's side of the window.

Figure 2:
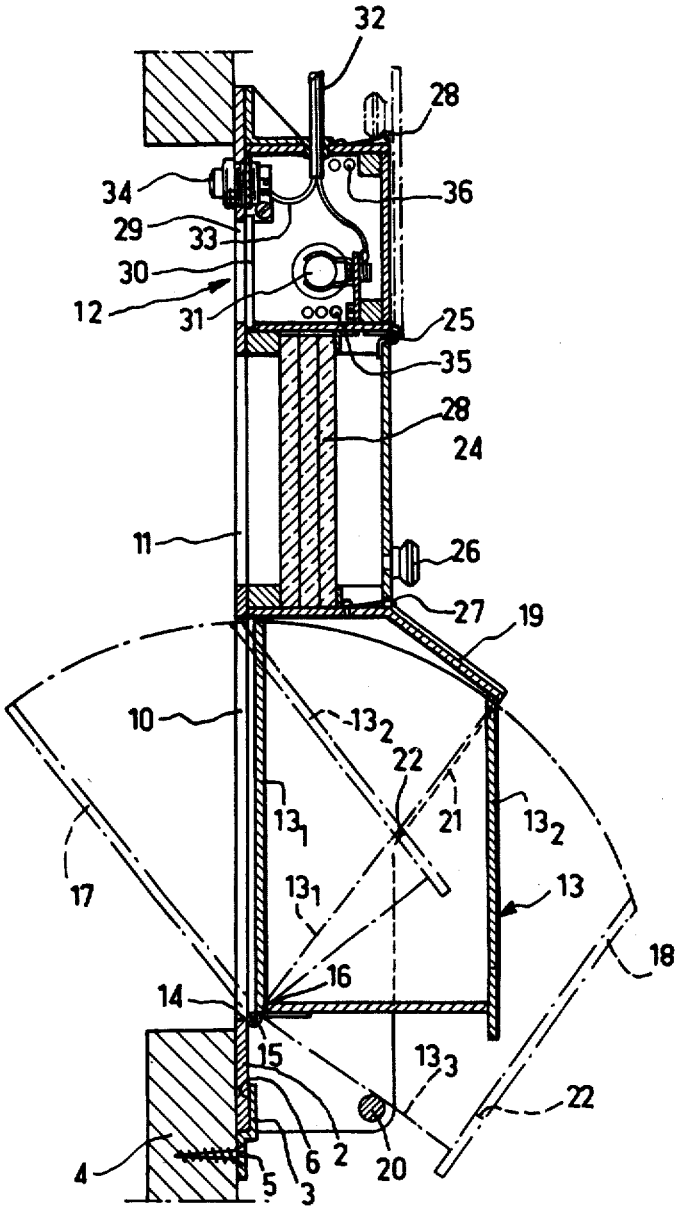
FIG. 2 is a sectional view taken on line AA of FIG. 1.

When the trough is pivoted to the public side (position 17), the opening is closed by the rear wall $13_2$ of the trough as shown in dot-dash lines in FIG. 2.

Consequently, whatever be the position of the trough at the moment of the exchanges, the public can in no way have access to the interior of the private premises which constitutes a physical sealing of the counter window opposing the passage of an arm, a hand, a firearm or other means.

The angular movements of the trough are limited by two stops, one being formed by a pin 20 which extends transversely of the counter window and is fixed in the two sides 21 of the frame, the other being formed by a heel 22 which projects from the lateral sides 23 of the trough and come in contact with the side walls of the frame when the trough is pivoted to position 17 (public side), as it is particularly clear from FIG. 1.

On the other hand, when the trough is pivoted to position 18 (the official's side), the bottom wall $13_3$ of the trough bears against the pin 20 so that its travel is limited. It will be understood that any other end-of-travel abutment may be used, the illustrating stop having being shown merely by way of example.

The peep hole 11 is normally closed by a peep hole cover 24 pivotally mounted at 25 on the frame of the window. This cover comprises a shifting knob 26 and an elastically yieldable locking means 27 and 28 in the form of a spring blade which holds the peep hole cover in its closed or open position as illustrated in FIG. 2.

The peep hole 11 on the public side is masked by the movable peep hole cover 24 on the official's side. In an intermediate plane, a fixed bullet-proof glass 28 of a width substantially larger than that of the peep hole 11 and less than that of the peep hole cover 4 mounted in staggered relation and defining two lateral sound holes which are not seen in the drawings and serve merely to allow through sounds and permit a free auditory communication between the public and the official.

The signalling box comprises an opening 29 cut in the frame, this opening being closed by a translucent glass 30 for example of opaline whih may have information for the public printed or engraved thereon.

This box is illuminated by a fluorescent tube 31 supplied with current by the cable 32 the wire 33 of which is connected to a bell actuator 34 adapted to inform the official of the visit of a user.

This box has lateral openings 35 and 36 for ventilation owing to the heat produced by the tube 31.

This device, owing to its sealed and detachable design, will be particularly appreciated by chemists especially as these practitioners will no longer be obliged to keep awake unnecessarily or to double the personnel on night duty since the user merely by ringing the bell can alert the night watchman and immediately obtain the remedies he requires (with no need to call the police service as happens at the present time).

In this respect, the pin 20 acting as an end-of-travel stop for the trough 13 is detachable so that the practitioner can completely open up the exchange opening 10 if he must at times transmit to the customer objects having a size exceeding the capacity of the trough.

It must be understood that the invention is not intended to be limited to the embodiment described hereinbefore, since other forms and other modes may be envisaged without departing from the scope of the invention defined in the accompanying drawings.

We claim:

1. A protected counter window comprising a frame for being secured over an opening through a partition wall which separates a private side from a public side, said frame having a frame plane part on the public side and having a transfer passage through the frame forming a private side opening on the private side of the frame and a public side opening which is located in the frame plane part and has a selected contour in the frame plane part, a trough including a plane public side trough wall part which has a contour that fits said contour of the public side opening and a private side trough wall part, said public side trough wall part and said private side trough wall part having upper edges that define a filling opening for the trough, guide means mounting said trough in said transfer passage for movement between a first position on the public side in which the filling opening of the trough is located at least partially, on the public side, beyond the public side opening of the frame, while the private side trough wall part totally blocks the transfer passage of the frame, and a second position in which the filling opening is located at least partially, on the private side, beyond the private side opening of the frame, while the public side trough wall part totally blocks said transfer passage, stop means of the frame and on the trough to limit the movement of the trough between said first and second positions, a protective part extending on the private side of the frame and arranged crosswise in relation to the frame plane part on the public side, said protective part including at least an upper part having a surface at least equal in size to the filling opening of the trough, said trough being mounted by said guide means for movement to a third position intermediate said first and second position and whereat the plane public side trough wall part is located substantially in the plane of the public side opening of the frame plane part, while the upper part of the protective part totally blocks the filling opening of the trough, and releasable locking means on the frame and on the trough to immobilize the trough in said third position so that the trough, in this third position, is totally inaccessible from either the private side or the public side.

2. A protected counter window according to claim 1 wherein the frame includes a side plate, and the locking means includes a locking knob which extends through said side plate of the frame for cooperating with the trough to hold the trough in the third position.

3. A protected counter window according to claim 1 wherein the public side opening of the frame is rectangular and the trough has a substantially parallelepipedic shape, the private side wall part of the trough includes a plane interior wall part joined to the public side wall part by two side wall parts and a bottom.

4. A protected counter window according to claim 1, wherein the guide means includes a revolving articulation connecting the public side wall trough part and an edge of the public side opening of the frame, so that the trough is mounted to move in rotation between said first and second positions.

5. A protected counter window according to claim 3 wherein the public side opening of the frame and the public side wall trough part have horizontal lower edges, and wherein the guide means includes a revolving articulation connecting said lower edges, said upper part of the protective part of the frame having the shape of an arch portion.

6. A protected counter window according to claim 1 wherein the protective part of the frame comprises at least a side plate fastened, on the public side, onto the frame plane part, and having a free edge on the private side, and the private side wall trough part includes at least a part of a side wall having a heel projecting from the part of the side wall, said free edge of the frame plate and said heel of the side wall part of the trough constituting a first stop means associated with said first position of the trough.

7. A protected counter window according to claim 6 wherein the protective part of the frame comprises two side plates fastened, on the public side, onto the frame plane part and between which is fastened, at their lower end, a horizontal pin, and the private side wall trough part includes a bottom, said horizontal pin and said bottom constituting a second stop means associated with said second position of the trough.

8. A protected counter window as claimed in claim 1 wherein said frame includes a planar flange coplanar with the frame plane part and extending around the periphery of the frame; and there is included a groove member having a groove for receiving a bottom portion of the flange, said groove member being mountable on the private side of the partition wall below the opening therethrough, and a releasable member being mountable on the private side of the partition wall for engaging an upper portion of the flange to secure the frame over the opening through the partition wall whereby the frame may be easily removed from the opening.

* * * * *